US005740495A

United States Patent [19]

Maher et al.

[11] Patent Number: 5,740,495

[45] Date of Patent: Apr. 14, 1998

[54] APPARATUS AND METHOD FOR ADJUSTING CLEANING SYSTEM PERFORMANCE ON AN ELECTROSTATOGRAPHIC RECORDING APPARATUS

[75] Inventors: James C. Maher, North Rose; James F. Paxon, Rochester, both of N.Y.

[73] Assignee: Eastman Kodak Company, Rochester, N.Y.

[21] Appl. No.: 770,601

[22] Filed: Dec. 19, 1996

[51] Int. Cl.[6] ..... G03G 15/00; G03G 21/00

[52] U.S. Cl. ..... 399/71; 399/49; 399/354; 399/355; 399/356

[58] Field of Search ..... 399/71, 49, 353, 399/356, 355, 354, 343, 51

[56] References Cited

U.S. PATENT DOCUMENTS

| | | | |
|---|---|---|---|
| 4,473,029 | 9/1984 | Fritz et al. . | |
| 4,546,060 | 10/1985 | Miskinis et al. . | |
| 4,712,906 | 12/1987 | Bothner . | |
| 4,967,238 | 10/1990 | Bares et al. . | |
| 5,253,934 | 10/1993 | Potucek et al. . | |
| 5,257,039 | 10/1993 | Chung et al. . | |
| 5,257,079 | 10/1993 | Lange et al. . | |
| 5,300,960 | 4/1994 | Pham et al. . | |
| 5,546,177 | 8/1996 | Thayer et al. . | |
| 5,631,728 | 5/1997 | Rushing et al. | 399/51 X |
| 5,657,114 | 8/1997 | Kitajima et al. | 399/71 |

*Primary Examiner*—S. Lee
*Attorney, Agent, or Firm*—Norman Rushefsky

[57] ABSTRACT

An electrostatographic recording apparatus and method includes recording of electrostatic images and a patch area on an endless imaging member. The recording is operative in accordance with adjustable parameters to adjust density of the patch area. A development station is operative in accordance with another parameter for adjusting density of the images and the patch area. A sensor senses density of a toned patch area and generates a first signal representing density of the toned patch area. A transfer station transfers images on the image member to a transfer medium. A cleaning station located downstream of the sensor and the transfer station cleans remnant toner and the patch area on the imaging member. The cleaning station is adjustable to alter cleaning performance. A process controller is responsive to the first signal and adjusts density of a subsequently formed toned patch area; and a controller is responsive to a second signal related to density of a toned patch area and the patch area after cleaning for adjusting an adjustable parameter of the cleaning station to adjust cleaning performance of the cleaning station.

19 Claims, 5 Drawing Sheets

APPARATUS AND METHOD FOR ADJUSTING CLEANING SYSTEM PERFORMANCE ON AN ELECTROSTATOGRAPHIC RECORDING APPARATUS

BACKGROUND OF THE INVENTION

1. Field of the Invention

This invention relates to a method and apparatus for control of process conditions in an electrostatographic recording apparatus and, more particularly, to control of cleaning system performance in such an apparatus.

In electrostatographic recording apparatus, it is known to use process control patches that are recorded, for example, on interframe areas of a primary imaging member to monitor process conditions and provide control of such conditions. In commonly assigned U.S. application Ser. No. 08/594,955, filed in the names of Rushing et al, the contents of which are incorporated herein by reference, an electrophotographic recording apparatus is described wherein a patch of toned density is recorded and developed on an electrophotoconductive recording member in an interframe area. The density of the patch is sensed and used in association with other sensed parameters in the process to provide adjustments to primary voltage $V_o$, exposure $E_o$. and/or development station bias voltage $V_B$.

In U.S. Pat. No. 5,546,177 to Thayer, an electrophotographic recording apparatus is provided with a cleaning brush to remove untransferred toner from an electrophotoconductive belt so that the belt can be reused for recording subsequent images. The patent describes that performance of the cleaning brush may be monitored by placement of a patch of a predetermined length on the belt and then measuring a length of the removed path on the cleaning brush. The efficiency of the cleaning process through the life of the brush may be monitored. The monitoring is used to determine when preventive maintenance can be initiated or in testing to determine what parameters can be altered to avoid cleaning failure such as increasing brush speed or brush bias. A problem associated with the approach of Thayer is that placement of a sensor in the location of the cleaning brush can be a problem since the brush is located in a housing and the environment of the housing tends to accumulate toner remnants which can provide false readings regarding brush performance.

U.S. Pat. No. 4,967,238 to Bares et al is also directed to a cleaning brush performance monitoring system. In this patent, a sensor located after the cleaning brush and before the development station includes an illuminating source to monitor a photoconductive surface for changes in reflectivity which are thus attributed to failure of the cleaning brush. Cleaning brush effectiveness is also disclosed to be monitored by positioning a light source and a detector on opposite sides of the photoreceptor to detect toner illuminated thusly. The monitor for the cleaning brush is provided across the width of the photoconductor to detect debris. Debris counts are detected and when a selected value is exceeded, a signal indicating cleaner rejuvenation, repair or replacement is produced. A problem with the approach of Bares et al is the requirement of monitoring the entire width of the photoconductive member and the need to maintain counts to detect failures in the cleaning brush.

It is an object of this invention to provide an improved process control system which overcomes the problems of the prior art.

SUMMARY OF THE INVENTION

The above and other objects are accomplished by an electrostatographic recording apparatus comprising an endless imaging member; an image recording device for recording electrostatic images and a patch area on the imaging member, the recording device being operative in accordance with a first adjustable parameter adjusting density of images and density of the patch area; a development station for developing the electrostatic images on the imaging member and toning the patch area, the development station being operative in accordance with a second parameter for adjusting density of the images and the patch area; a sensor for sensing density of a toned patch area and generating a first signal representing density of the toned patch area; a transfer station for transferring images on the image member to a transfer medium; a cleaning station located downstream of the sensor and the transfer station for cleaning remnant toner and the patch area on the imaging member, the cleaning station being adjustable to alter cleaning performance; a process controller responsive to the first signal for adjusting density of a subsequently formed toned patch area; and a controller responsive to a second signal related to density of a toned patch area and the patch area after cleaning for adjusting an adjustable parameter of the cleaning station to adjust cleaning performance of the cleaning station.

In accordance with another aspect of the invention, there is provided an electrostatographic recording method comprising recording electrostatic images and a patch area on an imaging member with a recording device that operates in accordance with a first adjustable parameter that adjusts density of images and density of the patch area; developing the electrostatic images on the imaging member and toning the patch area at a development station that operates in accordance with a second parameter for adjusting density of the images and the patch area; sensing density of the toned patch area and generating a first signal representing density of the toned patch area; transferring images on the image member to a transfer medium; cleaning remnant toner and the patch area on the imaging member at a cleaning station, the cleaning station being adjustable to alter cleaning performance; in response to the first signal adjusting density of a subsequently formed toned patch area; and in response to a second signal related to density of a toned patch area and the patch area after cleaning for adjusting an adjustable parameter of the cleaning station to adjust cleaning performance of the cleaning station.

BRIEF DESCRIPTION OF THE DRAWINGS

In the detailed description of the preferred embodiments of the invention presented below, reference is made to the accompanying drawings in which.

DESCRIPTION OF THE PREFERRED EMBODIMENTS

The present invention is described below in the environment of an electrophotographic copier and/or printer.

However, it will be noted that although this invention is suitable for use with such apparatus, it also can be used with other types of electrophotographic copiers and printers and electrostatographic recorders.

Because apparatus of the general type described herein are well known the present description will be directed in particular to elements forming part of, or cooperating more directly with, the present invention.

To facilitate understanding of the foregoing, the following terms are defined:

$V_B$=Development station electrode bias.

$V_O$=Primary voltage (relative to ground) on the photoconductor as measured just after the primary charger. This is sometimes referred to as the "initial" voltage.

$E_O$=Light produced by the printhead to form a density $D_{MAX}$.

Figure 1:
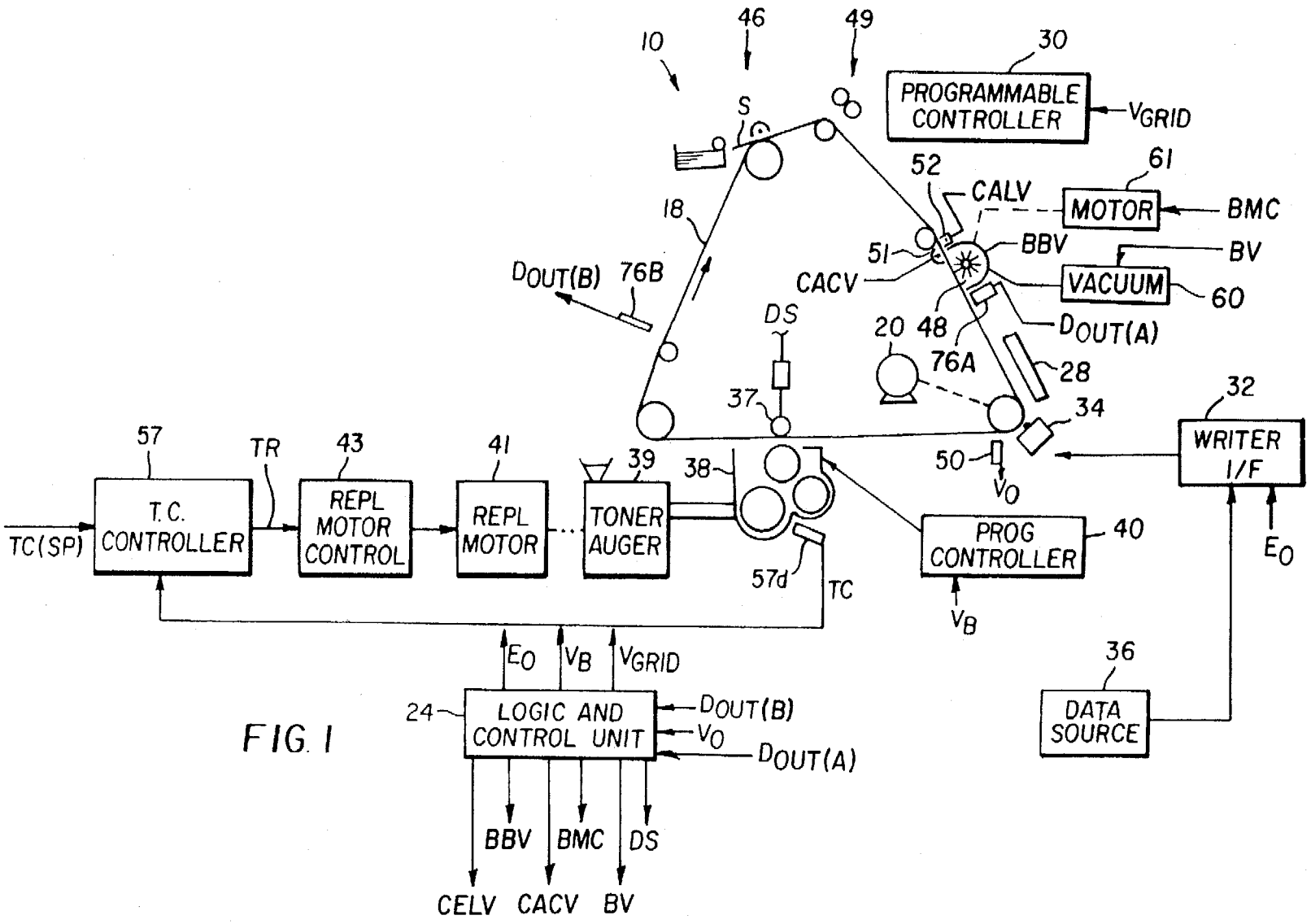
FIG. 1 is a schematic showing a side elevational view of an electrostatographic apparatus in which the present invention is useful.

With reference to the apparatus 10 as shown in FIG. 1, a moving recording member such as photoconductive belt 18 is driven by a motor 20 past a series of work stations of the printer. A logic and control unit (LCU) 24, which has a digital computer, has a stored program for sequentially actuating the various work stations.

Briefly, a charging station 28 sensitizes belt 18 by applying a uniform electrostatic charge of predetermined primary voltage $V_O$ to the surface of the belt. The output of the charger is regulated by a programmable controller 30, which is in turn controlled by LCU 24 to adjust primary voltage $V_O$ for example through control of electrical potential ($V_{GRID}$) to a grid that controls movement of charged particles, created by operation of the charging wires, to the surface of the recording member as is well known.

At an exposure station 34, projected light from a write head dissipates the electrostatic charge on the photoconductive belt to form a latent image of a document to be copied or printed. The write head preferably has an array of light-emitting diodes (LEDs) or other light source such as a laser for exposing the photoconductive belt picture element (pixel) by picture element with an intensity regulated in accordance with signals from the LCU to a writer interface 32 that includes a programmable controller. Alternatively, the exposure may be by optical projection of an image of a document or a patch onto the photoconductor. It is preferred that the same source that creates the patch used for process control to be described below also exposes the image information.

Where an LED or other electro-optical exposure source is used, image data for recording is provided by a data source 36 for generating electrical image signals such as a computer, a document scanner, a memory, a data network, etc. Signals from the data source and/or LCU may also provide control signals to a writer network, etc. Signals from the data source and/or LCU may also provide control signals to the writer interface 32 for identifying exposure correction parameters in a look-up table (LUT) for use in controlling image density. In order to form patches with density, the LCU may be provided with ROM memory or other memory representing data for creation of a patch that may be input into the data source 36. Travel of belt 18 brings the areas bearing the latent electrostatic images into a development station 38. The development station has one (more if color) magnetic brushes in juxtaposition to, but spaced from, the travel path of the belt. Magnetic brush development stations are well known. For example, see U.S. Pat. Nos. 4,473,029 to Fritz et al and 4,546,060 to Miskinis et al.

LCU 24 may selectively activate the development station in relation to the passage of the image areas containing latent images to selectively bring the magnetic brush into engagement with or a small spacing from the belt. Such activation may be made by advancement of a backup roller 37 or bar in response to a signal from the LCU or other known activation. The charged toner particles of the engaged magnetic brush are attracted imagewise to the latent image pattern to develop the pattern.

As is well understood in the art, conductive portions of the development station, such as conductive applicator cylinders, act as electrodes. The electrodes are connected to a variable supply of D.C. potential $V_B$ regulated by a programmable controller 40. Details regarding the development station are provided as an example, but are not essential to the invention.

A transfer station 46, as is also well known, is provided for moving a receiver sheet S into engagement with the photoconductor belt in register with the image for transferring the image to the receiver sheet. Alternatively, an intermediate member may have the image transferred to it and the image may then be transferred to the receiver sheet. A cleaning station is also provided subsequent to the transfer station for removing toner from the belt 18 to allow reuse of the surface for forming additional images. The cleaning station includes a cleaning brush 48 in engagement with the surface of the belt for removing remnants of toner particles not transferred to the receiver sheet. There optionally may also be provided a clean assist charger 51 to deposit charge on the belt to assist removal of the charge by the belt and/or a charge erase lamp 52. The clean assist charger and charge erase lamp may be located on either the front or the back of the belt. Other cleaner assist devices may include cleaning blades which also engage the belt for removing remnants of toner and paper particles. The brush 48 may be a fiber or fur brush or a magnetic cleaning brush. An example of a preferred fiber brush is described in commonly assigned U.S. Application Serial No. (filed Dec. 3, 1996 in the names of James Maher et al and entitled "Photoconductor Cleaning Brush to Prevent Formation of Photoconductor Scum") The brush is preferably enclosed in a housing and a vacuum from an adjustable vacuum source 60 is maintained to clean the brush of toner "dirt" or remnants which is picked up by the brush. This toner dirt is conveyed by the vacuum to a collection container. The brush is driven by a brush motor 61 or other drive. The LCU may be programmed to provide various adjustments to the cleaning station operation through adjustment of one or more of the following parameters: cleaner assist charging voltage (CACV), charge erase lamp voltage (CELV), brush motor current (BMC), brush vacuum (BV), brush bias voltage (BBV) which establishes an electrostatic attraction of the toner to the brush on electrically conductive fur or fiber brushes or magnetic cleaning brushes or detoning rollers used with magnetic cleaning brushes.

In lieu of a belt, a drum photoconductor or other structure for supporting an image may be used. After transfer of the unfixed toner images to a receiver sheet, such sheet is transported to a fuser station 49 where the image is fixed and the sheet may then be output to a tray or recirculated back to receive an image on a second side for duplex operation as is well known.

The LCU provides overall control of the apparatus and its various subsystems as is well known. Programming commercially available microprocessors is a conventional skill well understood in the art. The following disclosure is written to enable a programmer having ordinary skill in the art to produce an appropriate control program for such a microprocessor. In lieu of only microprocessors the logic operations described herein may be provided by or in combination with dedicated or programmable logic devices.

Process control strategies generally utilize various sensors to provide real-time control of the electrostatographic process and to provide "constant" image quality output from the user's perspective.

One such sensor may be a densitometer 76B to monitor development of test patches in non-image areas of photoconductive belt 18, as is well known in the art. The densitometer is intended to insure that the transmittance or reflectance of a toned patch on the belt is maintained. The densitometer may comprise an infrared LED which shines through the belt or is reflected by the belt onto a photodiode. In the preferred embodiment, the patch nominal density is at the high density ($D_{MAX}$) end of the time scale, and the densitometer is of the transmission type. A densitometer signal with high signal-to-noise ratio is obtained in the preferred embodiment, but a lower nominal density level and/or a reflection densitometer would be reasonable alternatives in other configurations. The photodiode generates a voltage $D_{OUT(B)}$ proportional to the amount of light received. This voltage is compared to the voltage $D_{BARE\ PATCH}$ generated due to transmittance or reflectance of a bare patch which may be adjacent or near the toned patch, to give a signal representative of an estimate of toned density. Preferably the bare patch is just downstream or upstream of the toned patch so that the same densitometer can take the density reading. This signal $D_{out}$, may be used to adjust $V_o$, $E_o$, or $V_B$;, to assist in the maintenance of the proper concentration of toner particles in the developer mixture and in accordance with the invention to adjust parameters for operation of the cleaning brush as will be described below.

As noted in the aforementioned Rushing et al application, the density signal is used to detect short term changes in density of a measured patch to control primary voltage $V_o$, exposure $E_o$, and/or bias voltage $V_B$. To do this, $D_{out}$ is compared with a set point density value or signal $D_{sp}$ and differences between $D_{out}$ and $D_{sp}$ cause the LCU to change settings of $V_{GRID}$ on charging station 28 and adjust exposure $E_o$ through modifying exposure duration or light intensity for recording a pixel. Adjustment to the potential $V_B$ at the development station is also provided for.

In accordance with the invention described in commonly assigned U.S. application Ser. No. 60/002,661, filed Aug. 22, 1995 in the names of Rushing et al, long-term changes in toning contrast may be compensated for by adjustment of the toner concentration setpoint TC (SP) of a toner concentration (TC) controller 57. The TC controller, in turn, adjusts the short term rate of toner replenishment. In a two-component developer provided in development or toning station 38, toner gets depleted with use whereas magnetic carrier particles remain thereby affecting the toner concentration in the development station. Addition of toner to the development station may be made from a toner replenisher device 39 that includes a source of toner and a toner auger for transporting the toner to the development station. A replenishment motor 41 is provided for driving the auger. A replenishment motor control circuit 43 controls the speed of the auger as well as the times the motor is operating and thereby controls the feed rate and the times when toner replenishment is being provided. Typically, the motor control 43 operates at various adjustable duty cycles that are controlled by a toner replenishment signal TR that is input to the replenishment motor control 43. Typically, the signal TR is generated in response to a detection by a toner monitor of a toner concentration that is less than that of a set point value. For example, a toner monitor probe **57*d*** is a transducer that is located or mounted within or proximate the development station and provides a signal TC related to toner concentration. This signal is input to a toner monitor which in a conventional toner monitor causes a voltage signal $V_{MON}$ to be generated in accordance with a predetermined relationship between $V_{MON}$ and TC. The voltage $V_{MON}$ is then compared with a fixed voltage of say 2.5 volts which would be expected for a desired toner concentration of say 10 %. Differences of $V_{MON}$ from this fixed voltage are used to adjust the rate of toner replenishment or the toner replenishment signal TR. In a more adjustable type of toner monitor such as one manufactured by Hitachi Metals, Ltd., the predetermined relationship between TC and $V_{MON}$ offers a range of relationship choices. With such monitors, a particular parametric relationship between TC and $V_{MON}$ may be selected in accordance with a voltage input representing a toner concentration set point signal value, TC(SP). Thus changes in TC(SP) can affect the rate of replenishment by affecting how the system responds to changes in toner concentration that is sensed by the toner monitor.

While the above approach suggested for the control of toning contrast by control of toner concentration works well to gradually compensate the long-term effects of developer aging, the invention described in application Ser. No. 08/594,955 is directed to compensating short-term environmental changes and rest/run effects by control of $V_o$ and $E_o$ and is sufficiently robust as to be useable with other techniques for controlling toning contrast and for controlling toner concentration.

Figure 2:
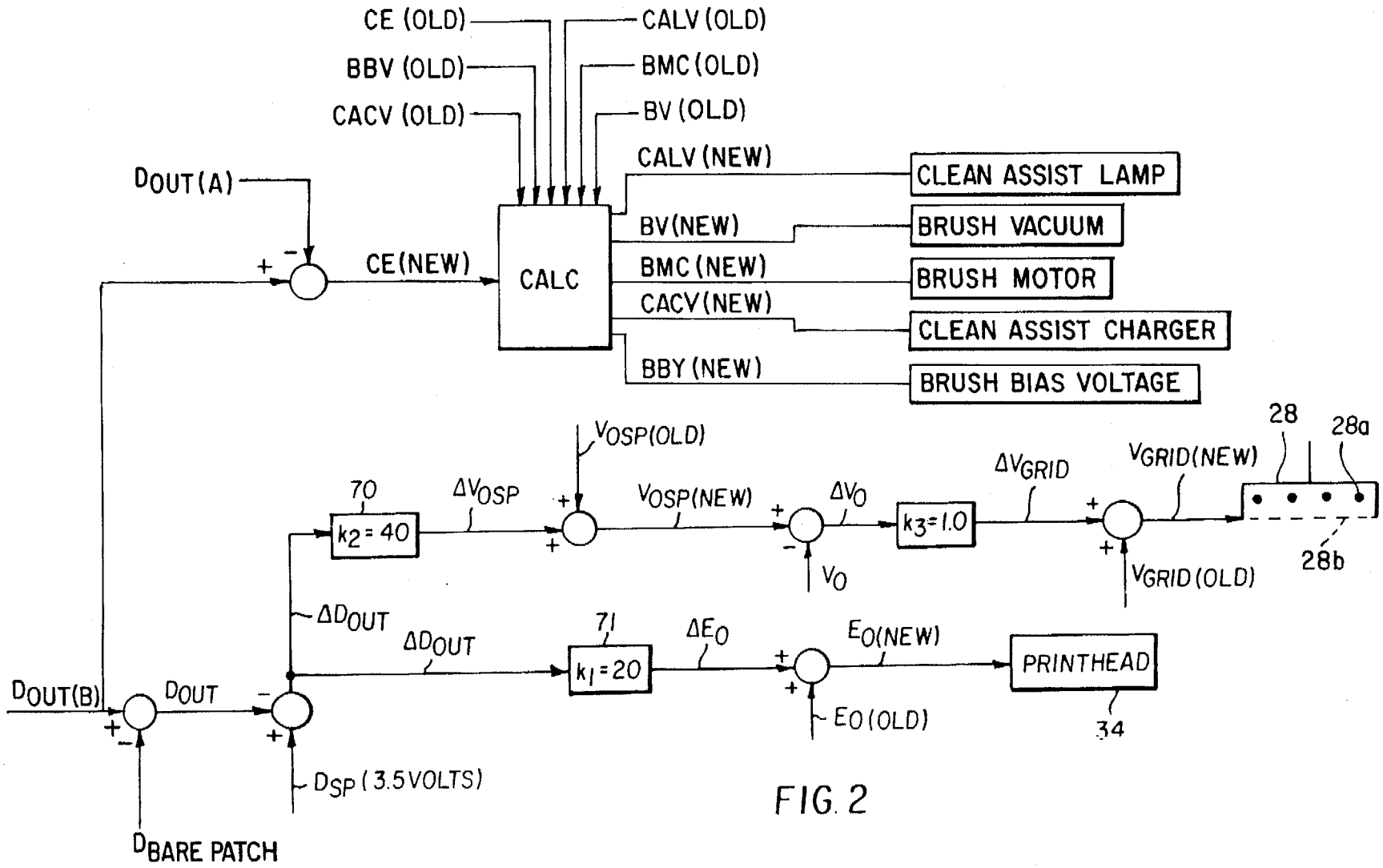
FIG. 2 is a schematic of an algorithm for control of $V_o$ and $E_o$ and cleaning brush parameters in the apparatus of FIG. 1 and FIGS. 3A and 3B are flowcharts of a program operative for determining new values of $V_o$, $E_o$ and cleaning brush operation during operation of the apparatus of FIG. 1.

With reference now to FIG. 2, there is shown a programmable controller for controlling parameters VO, generated by the primary corona charger 28, and $E_o$ generated by the LED printhead 34 of FIG. 1 which are used in the recording of the next image and/or test patch. In addition, the controller forming part of the LCU is used to adjust one or more of the cleaning brush parameters in accordance with a programmed algorithm which is heuristically determined.

As is well known, control of $V_o$ is advantageously provided for by adjustment of the potential to a grid **28*b* in those primary chargers which employ such a grid. With such chargers, corona or charged ions generated by the corona wires 28*a*, which are at an elevated potential level, are caused to pass through the grid to an insulating layer on the photoconductor, which photoconductor is otherwise grounded. The charge level builds on this insulating layer to a level proximate that of the potential on the grid. Thus $V_{GRID}$, the potential on the grid, provides a reasonably close correspondence to the primary charge $V_o$ created on the photoconductor. Other primary chargers that do not employ a grid may also be used. Control of $E_o$ is preferably made by control of current to an electronic exposure source such as LED printhead 34 or a laser. Examples of LED printheads are described in U.S. Pat. Nos. 5,253,934; 5,257,039 and 5,300,960 and U.S. application Ser. No. 08/581,025, filed Dec. 28, 1995 in the names of Michael J. Donahue et al and entitled "LED Printhead and Driver Chip For Use Therewith Having Boundary Scan Test Architecture" and Ser.. No. 08/580,263, filed Dec. 28, 1995 in the names of Yee S. Ng et al and entitled "Apparatus and Method for Grey Level Printing with Improved Correction of Exposure Parameters." In the references just described, there are illustrated examples of LED printheads which are formed of plural chip arrays arranged in a single row. Typically, 64, 96, 128 or 196 LEDs are arranged on a chip array in a row and when the chip arrays are in turn arranged on a printhead support, a row of several thousand LEDs is provided that is made to extend across, and preferably perpendicular, to the direction of movement of the photoconductor. Desirably, the number of LEDs (typically five to six thousand) are such so as to extend for the full width or available recording width of the photoconductor so that the LED printhead may be made stationary. The LEDs are typically fabricated to be pitched at 1/300th or better yet 1/600th to the inch in the cross-track dimension of the photoconductor. Control of current and selective enablement is provided by driver chips that are also mounted on the printed. Typically, one or two driver chips are associated with each LED chip array to provide a controlled amount of current to an LED selected to record a particular pixel at a particular location on an image frame of the photoconductor. Since LED printing is conventional, further details are either well known or may be obtained from the aforementioned references. In control of current to each LED for recording a pixel, the above patent literature notes that two parameters may be used. One of the parameters referred to in this literature has to do with a global adjustment parameter or capability for the LED printhead. With a global adjustment capability, which we may call "$G_{REF}$" (also known in the patent literature as $V_{REF}$) there is provided the ability to change by a certain amount current generated by the driver chips for driving LEDs selected to be enabled. The LED printheads disclosed in the above patent literature may also have a local adjustment capability ($L_{REF}$) that may be used to adjust current generated by some driver chips differently than current generated by others. The reasons for providing both global and local current adjustment capability is that LED driver chips and LEDs on certain chips may vary from batch to batch due to process differences during manufacture. When the LED printhead is manufactured, these process differences may be accommodated for by allowing selection of different currents generated by different driver chips on the same printhead. In addition, if a printhead while in use has temperature differentials on the printhead, provision may be made for controlling current to a different extent for each driver chip. However, due to aging of the printhead and/or changes in electrophotographic process conditions, global changes to driver current are advantageously provided for in order to change the parameter $E_o$. In a system which employs discharge area development, exposure of a pixel area by an LED will cause that pixel area to be developed. The more the exposure, the greater the density until an exposure is provided that provides a maximum development capability. Thus, for example, to create a patch of density $D_{MAX}$, a block of many LEDs similarly illuminated can create an exposed patch area on the photoconductive belt 18**.

Figure 3A:
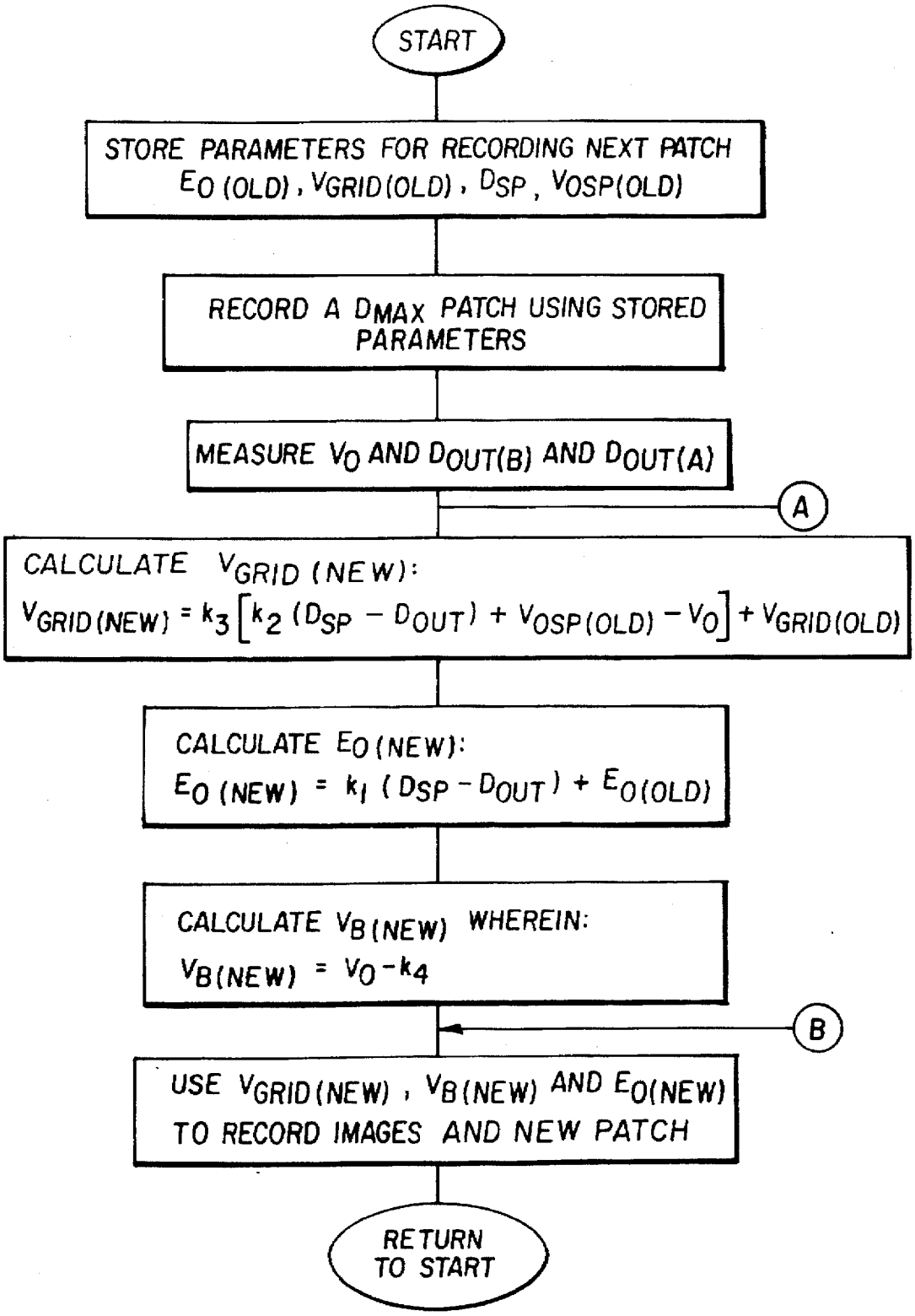
Figure 3B:
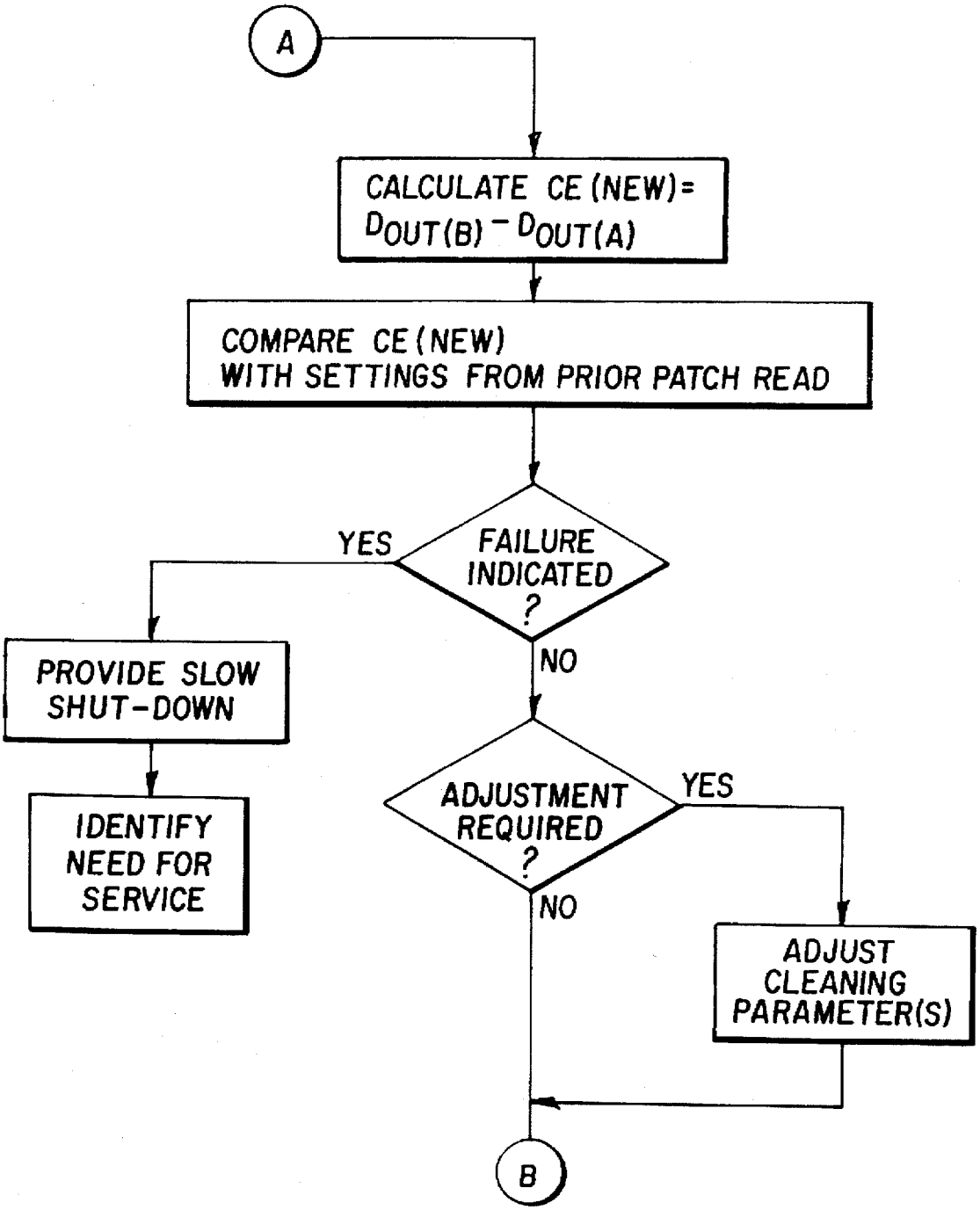

With reference now to FIGS. 2, 3A and 3B, the apparatus of FIG. 1 under control of the programmed logic and control unit 24 causes a calibration mode to be entered every few image frames; for example, every 5 or 6 image frames (fewer or more frames may be used depending upon stability or other matters associated with the process). In this mode, parameters used for recording a next set of patches each of $D_{MAX}$ density are stored in memory. The set of patches may be in an interframe area on the photoconductor and several may be recorded throughout the width of the photoconductor to ensure similar operation of selected groups of LEDs. The typical parameters of interest are $E_o$, $V_{GRID}$, $D_{sp}$ (set point for maximum densitometer output typically is 3.5 volts when transmission densitometer output is measured and a deduction taken for losses through the transparent photoconductor). After a $D_{MAX}$ patch or set of $D_{MAX}$ patches is recorded, $D_{OUT(B)}$ of the patch and $V_o$ on the photoconductor in a non-exposed area are measured and signals representing same are generated. The term $D_{OUT(B)}$ refers to the density of the toned patch before cleaning. A signal representing $D_{OUT(B)}$ is then compared with a signal representing a bare patch $D_{BARE\ PATCH}$ and the signal $D_{OUT}$ generated from the difference. The signal $D_{OUT}$ is then compared with $D_{SP}$. The difference between $D_{OUT}$ and $D_{sp}$ are used to generate an error signal $\Delta D_{OUT}$. In accordance with the invention of U.S. application Ser. No. 08/594,955, this error signal is multiplied in respective multipliers 70, 71 by two constants $k_1$ and $k_2$ having a fixed ratio, in this example, $k_2/k_1=2.0$. Also, in the preferred example, $k_2=40$ and $k_1=20$. For adjustments to $V_o$ (in volts), multiplying of $k_2$ by 40 indicates a needed change to the $V_o$ set point print $V_{OSP}$ and identified as $\Delta V_{OSP}$. The change in $V_{OSP}$, $\Delta V_{osp}$, is then added to (or if a negative change subtracted from) $V_{OSP}$ used to create the patch ($V_{OSP\ (OLD)}$) to generate a new $V_o$ set point signal, $V_{OSP\ (NEW)}$. The difference between a signal representing $V_{OSP(NEW)}$ and a signal representing measured $V_o$, which is used to create the patch, generates an error signal $\Delta V_o$. The signal representing $\Delta V_o$ is multiplied by a parameter $k_3$; in this case, $k_3=1.0$ to change a required change to the grid voltage level or $\Delta V_{GRID}$. A signal representing $\Delta V_{GRID}$ is then added (or subtracted) to the grid voltage used to generate the patch $V_{GRID(OLD)}$ to create a new $V_{GRID(NEW)}$ voltage that may be used for recording the next few image frames until a further adjustment is indicated by routine repetition of this process through creating of new patches and wherein the present new parameter values become the old parameter values.

The signal output from multiplier 71 represents an adjustment in $E_o$ and is identified as $\Delta E_o$. A signal representing $\Delta E_o$ is added to (or subtracted from) a signal representing the $E_o$ value (expressed in digital values or counts from 0 to 250 and as more fully described in U.S. application Ser. No. 08/594,955) used to create the patch $E_{o(OLD)}$. In this example, Eand $\Delta E_o$ are in terms of parameters used to generate current to the LEDs and more specifically $G_{REF}$ and $\Delta G_{REF}$ which is a change to the parameter $G_{REF}$. As noted in the above patent literature, a value $G_{REF}$ can be a digital value stored in a register on each of the driver chips. This digital value is used to enable certain transistors to control levels of current generated in a current generating circuit of the driver chips. Preferably, the values $G_{REF}$ and $L_{REF}$ (also referred to in the patent literature as $R_{REF}$), through selective enablement of certain transistors, control current generated in a master circuit wherein the LED driver channels are driven by slave circuits that are slaved off the master circuit. However, the value $E_o$ is shown generally in FIG. 2 because other printers or exposure sources may not use values of $G_{REF}$ to control $E_o$ and might even feature analog control of $E_o$, or as noted above, exposure could be from an optical exposure. The signal representing $\Delta E_o$ is added to the value of $E_{o(OLD)}$ (or $G_{REF(OLD)}$ specifically) used to create the patch to generate a signal representing a new value $E_o$ or $E_{o(NEW)}$ to be used along with the new value of $V_{GRID}$. Or $V_{GRID(NEW)}$ for recording the next few image frames for making copies or producing prints until the control process is repeated for producing adjustments thereto. These new values are also used to create a new test patch when the control process is to be repeated.

The toned patch density signal $D_{OUT(B)}$ sensed by sensor 76B is also compared with a signal $D_{OUT(A)}$ sensed by a second densitometer 76A, which is located downstream of the cleaning brush and before the development station 38. The signal $D_{OUT(A)}$ represents density on the belt in the respective toned patch area after the cleaning brush has removed all or most of the remnant or non-transferred toner. A difference signal CE(NEW) between $D_{OUT(B)}$ and $D_{OUT(A)}$ represents a measure relating to cleaning efficiency of the cleaning station. The signal CE(NEW) is then input to a calculating circuit or computer circuit or look-up table based device (CALC) which is responsive to other possible inputs such as, for example, values of the present settings of the charge assist cleaner voltage (CACV (OLD)) and/or the present clean erase lamp voltage (or current) (CELV(NEW)) and/or the prior cleaner efficiency difference signal (CE (OLD)) or instead or additionally, a set-point for cleaner efficiency, and/or the brush motor current (BMC (OLD) which controls present brush motor speed, the brush bias voltage (BBV(OLD)) and/or the present brush vacuum setting (BV (OLD)) or other related parameters.

In FIGS. 3A and 3B, a flowchart of a program is illustrated identifying an equivalent calculation which can be made by either using software or hardware calculators. In addition to calculating $E_{o(NEW)}$ and $V_{GRID(NEW)}$, a new value for use as a voltage bias to the development station $V_{B(NEW)}$ is generated by the relationship of $V_{B(NEW)}=V_{o-k4}$, wherein $k_4$ is a constant. It is well known that control of an electrophotographic process is provided by having a constant difference maintained between $V_o$ and $V_B$.

As may be seen in FIGS. 3A and 3B, signals $D_{OUT(B)}$ and $D_{OUT(A)}$ are measured and then in FIG. 3B used to calculate the value CE(NEW). CE(NEW) is then compared with the parameters used to create the patch to determine if there is indication of a cleaning station (typically cleaning brush) failure. If such is indicated, a slow shut-down of the machine may be provided and a signal generated to form a display identifying need for service and the indication of cleaning station failure. Additionally, communication by a tele-assistance modem may be provided to a service provider indicating the problem and need for service. If the value CE(NEW) is within a range that does not indicate failure, then the LCU determines if the current cleaning station parameter(s) require adjustment. If such adjustment is required, adjustments are made. For example, voltage may be increased to the cleaning assist charger (CAC) or brush motor speed voltage bias, vacuum and/or speed to increase toner removal. If the cleaning station is operating within specification, values may be maintained or selectively reduced to save energy or extend useful life of pads.

The new values relating to the brush parameters and $V_{GRID(NEW)}$, $V_{B(NEW)}$, and $E_{o(NEW)}$ are stored in a register or memory controlled or forming a part of the LCU and the latter three values used to record new images (as new image data is input) and the next toner patch.

Figure 4:
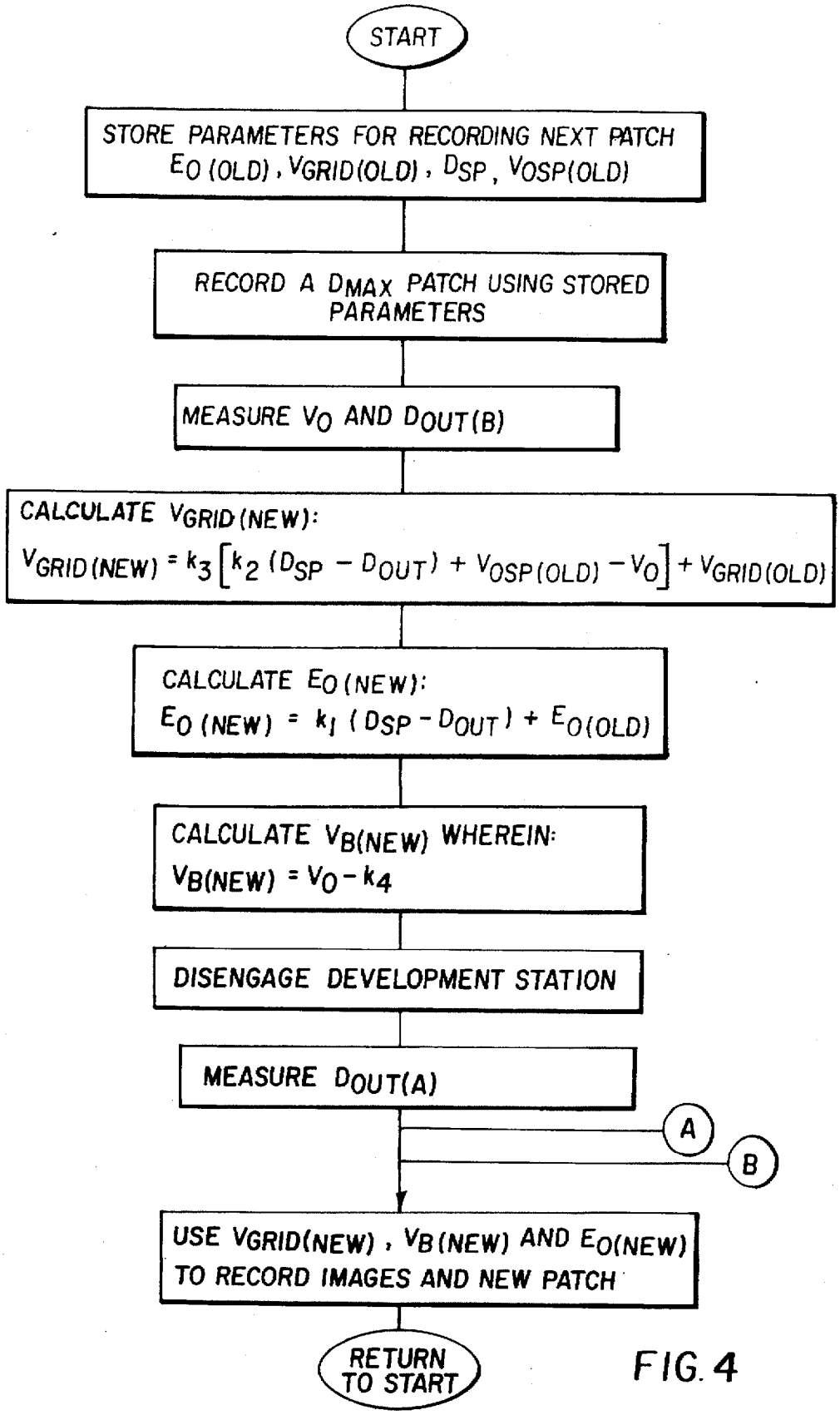
FIG. 4 is a flowchart of an alternate program for determining new values of $V_o$, $E_o$, and cleaning brush parameters during operation of a process control calibration run in the apparatus of FIG. 1.

In an alternative embodiment whose operation will be described with reference to the flowcharts of FIG. 4 and FIG. 3B and the apparatus of FIG. 1, operation is similar to that for the embodiment described above except that the sensor 76A located after the cleaner is eliminated and the sensor 76B is used to sense the density of the toned patch and the density of the patch area that is cleaned. The advantage of using an interframe patch is that patches may be located at specific locations between recording of image frames. The LCU, through timing signals that are generated using an encoder or other timing device relating to movement of the belt is programmed to determine the location for the specific areas of the belt; i.e., the patch areas which are investigated for cleaning efficiency of the cleaning station. An advantage of using one sensor for sensing the toned and cleaned patch area is the elimination of the extra sensor and the need to calibrate two sensors. In order to use the sensor 76B for sensing a toned patch area and the same area after being cleaned, it is necessary that the cleaned patch area pass through the toning station 38. Some toning stations when engaged for development can scavenge remnant toner and other "dirt" from the photoconductor and thus upon reaching the sensor 76B, the sensor will be effectively detecting cleaning by both the cleaning station and the development station. Since scavenging of remnant toner at the toning station can cause contamination of the development station, it would be advantageous in apparatus where this is a concern to provide a skip frame and cause retraction or disengagement or development inhibition of the development station from the photoconductive web to reduce the scavenging capability and thereby provide a more accurate assessmeant of cleaning station efficiency. In this regard, one example of inhibiting development is to use a retractable roller 37 that engages the backside of the web and in accordance with an appropriately timed signal (DS) from the LCU causes the roller to advance or retract the belt to or from a position in the development zone. A further advantage of the apparatus and method described herein is the use of the same densitometer that controls patch density $D_{MAX}$ is used to sense patch density for cleaning efficiency, thus assuring that cleaning efficiency is measured with respect to an accurate most demanding case.

There has thus been described an improved apparatus and method for providing adjustments to the cleaning process in conjunction with process control in an electrophotographic process wherein new values of $V_o$ and $E_o$ are generated. While a specific process control algorithm has been disclosed for illustrative purposes it will be appreciated that other algorithms for process control may be used.

Although the preferred embodiments have been described with reference to formation of a test area as a patch that is formed in an interframe area, the invention also contemplates creation of one or more test areas within an image frame for reading of density for use in controlling $E_o$ and $V_o$ in accordance with the steps described herein.

The invention has been described in detail with particular reference to preferred embodiments thereof and illustrative examples, but it will be understood that variations and modifications can be effected within the spirit and scope of the invention.

We claim:

1. An electrostatographic recording apparatus comprising:

a moving endless imaging member;

an image recording device for recording electrostatic images and a patch area on the imaging member, the recording device being operative in accordance with a first adjustable for parameter for adjusting density of images and density of the patch area;

a development station for developing the electrostatic images on the imaging member and toning the patch area, the development station being operative in accordance with a second adjustable parameter for adjusting density of the images and the patch area;

a sensor for sensing density of a toned patch area and generating a first signal representing density of the toned patch area;

a transfer station for transferring images on the image member to a transfer medium;

a cleaning station for cleaning remnant toner and the patch area on the imaging member, the cleaning station being adjustable to alter cleaning performance and the cleaning station being located downstream of the sensor and the transfer station relative to a direction of movement of the imaging member;

a process controller responsive to the first signal for adjusting density of a subsequently formed toned patch area; and a controller responsive to a second signal related to density of a toned patch area and the patch area after cleaning for adjusting an adjustable parameter of the cleaning station to adjust cleaning performance of the cleaning station.

2. The apparatus of claim 1 wherein the cleaning station includes a vacuum source and the adjustable parameter is amount of vacuum.

3. The apparatus of claim 1 wherein the cleaning station includes a cleaning brush and an adjustable electrical bias source for providing an adjustable electrostatic field to attract toner to the brush.

4. The apparatus of claim 3 wherein the cleaning brush is a magnetic cleaning brush.

5. The apparatus of claim 1 wherein the cleaning station includes a rotating brush and a drive for rotating the brush and the adjustable parameter is speed of the brush.

6. The apparatus of claim 1 wherein the process controller controls timing of sensing of density of the patch area so that the sensor senses density of a toned patch area and senses density for a cleaned patch area, the cleaned patched area being sensed after the patch area has been cleaned and then subsequently passed through the development station.

7. The apparatus of claim 1 wherein a single device senses density of a toned patch area and density of the same area after being cleaned.

8. The apparatus of claim 1 and including a control for actuating density readings of a toned patch area by the sensor both before and after cleaning so that density readings are obtained of the density of a toned patch area at the same location on the imaging member.

9. An electrostatographic recording method comprising:

recording electrostatic images and a patch area on an imaging member with a recording device that operates in accordance with a first adjustable parameter that adjusts density of images and density of the patch area;

developing the electrostatic images on the imaging member and toning the patch area at a development station that operates in accordance with a second adjustable parameter for adjusting density of the images and the patch area;

sensing density of the toned patch area and generating a first signal representing density of the toned patch area;

transferring images on the image member to a transfer medium;

cleaning remnant toner and the patch area on the imaging member at a cleaning station, the cleaning station being adjustable to alter cleaning performance;

in response to the first signal adjusting density of a subsequently formed toned patch area; and in response to a second signal related to density of a toned patch area and the patch area after cleaning, adjusting an adjustable parameter of the cleaning station to adjust cleaning performance of the cleaning station.

10. The method of claim 9 wherein the cleaning station includes a vacuum source and the adjustable parameter is amount of vacuum.

11. The method of claim 9 wherein the cleaning station includes a cleaning brush and an adjustable electrical bias source for providing an adjustable electrostatic field to attract toner to the brush.

12. The method of claim 11 wherein the cleaning brush is a magnetic cleaning brush.

13. The method of claim 9 wherein the cleaning station includes a rotating brush and a drive for rotating the brush and the adjustable parameter is speed of the brush.

14. The method of claim 9 wherein a sensor senses density of a toned patch area and senses density for a cleaned patch area, the cleaned patched area being sensed after the patch area has been cleaned and then subsequently passed through the development station.

15. The method of claim 9 wherein a single device senses density of a toned patch area and density of the same area after being cleaned.

16. The method of claim 9 and providing density readings of a toned patch area both before and after cleaning so that density readings are obtained of the density of a toned patch area at the same location on the imaging member.

17. The method of claim 9 and in the step of developing the imaging member is developed with toner of different colors.

18. The method of claim 9 wherein the first adjustable parameter is primary charge level.

19. The method of claim 9 wherein the first adjustable parameter is exposure level.

* * * * *